US006014079A

United States Patent [19]

Huang

[11] Patent Number: 6,014,079

[45] Date of Patent: Jan. 11, 2000

[54] BURGLAR ALARM SYSTEM FOR AN ELECTRONIC APPARATUS WITH A SLOT

[76] Inventor: Dennis Huang, 5F, No, Lane 9, Ningpo E. St., Taipei, Taiwan

[21] Appl. No.: 09/175,334

[22] Filed: Oct. 20, 1998

[51] Int. Cl.[7] ..... G08B 13/14

[52] U.S. Cl. ..... 340/571; 340/568.1; 340/572.1; 340/539

[58] Field of Search ..... 340/539, 568.1, 340/568.2, 571, 572.1, 572.8

[56] References Cited

U.S. PATENT DOCUMENTS

| | | | |
|---|---|---|---|
| 5,086,290 | 2/1992 | Murray et al. | 340/539 |
| 5,402,104 | 3/1995 | LaRosa | 340/539 |
| 5,627,520 | 5/1997 | Grubbs et al. | 340/572.1 |
| 5,635,897 | 6/1997 | Kuo | 340/571 |
| 5,748,084 | 5/1998 | Isikoff | 340/568.1 |
| 5,757,271 | 5/1998 | Andrews | 340/568.1 |
| 5,781,109 | 7/1998 | Nakajima | 340/568.1 |
| 5,801,627 | 9/1998 | Hartung | 340/568.1 |

*Primary Examiner*—Jeffery A. Hofsass
*Assistant Examiner*—Van T. Trieu
*Attorney, Agent, or Firm*—Bacon & Thomas

[57] ABSTRACT

A burglar alarm system for an electronic apparatus with a slot comprises a radio transmitter unit and a radio receiver unit. The radio transmitter unit can transmit a radio code signal when inserted into the slot of the electronic apparatus. The radio receiver unit can be carried by a user to receive the code signal from the radio transmitter unit. The radio receiver unit automatically output an alarm signal when moved away from the electronic apparatus beyond a predetermined distance due to loss of reception of the code signal from the radio transmitter unit.

3 Claims, 5 Drawing Sheets

BURGLAR ALARM SYSTEM FOR AN ELECTRONIC APPARATUS WITH A SLOT

BACKGROUND OF THE INVENTION

The present invention relates to a burglar alarm system for an electronic apparatus with a slot.

Expensive electronic apparatus, such as notebooks computers, personal digital assistants, digital cameras, video cameras, spectrophotometers, waveform monitors and etc., commonly have a slot for receiving removable interface devices or information storage media such as diskettes or cards. These expensive electronic apparatus tend to be stolen due to the common characteristics of small size and high value. However, the known alarm system usually requires the above mentioned electronic apparatus to have some modifications. Therefore, a easy and use-friendly alarm system is required.

SUMMARY OF THE INVENTION

The present invention has been accomplished with the above circumstances in view. It is one object of the present invention to provide a burglar alarm system which can be directly installed with its radio transmitter unit in a slot of an electronic apparatus, so that the burglar alarm system automatically outputs an alarm signal when the electronic apparatus is moved beyond the receiving range of the radio receiver unit of the burglar alarm system. It is another object of the present invention to provide a burglar alarm system which is maintained in the alert status when the electronic apparatus under protection is taken away by a burglar. It is still another object of the present invention to provide a burglar alarm system that can be set in a search mode to search the location of the electronic apparatus under protection. According to the present invention, the burglar alarm system is designed for use with an electronic apparatus with a slot. The burglar alarm system comprises a radio transmitter unit which is controlled to transmit a radio code signal, and a radio receiver unit which receives the radio code signal from the radio transmitter unit. When in use, the radio transmitter unit is inserted into the slot of the electronic apparatus, and the radio receiver unit is carried by the user or installed in a predetermined location. When the electronic apparatus is moved away from the radio receiver unit beyond a predetermined distance, the receiving of the radio code signal is interrupted, causing an alarm device of the radio receiver unit to output an alarm signal. The radio transmitter unit can be operated manually through a manual on/off switch. Alternatively, the radio transmitter unit can be provided with an automatic on/off switch. When the radio transmitter unit is inserted into the slot of the electronic apparatus, the switch can be turned on automatically. Conversely, when the radio transmitter unit is removed from the slot, the switch can be turned off automatically.

DETAILED DESCRIPTION OF THE PREFERRED EMBODIMENT

Figure 1:
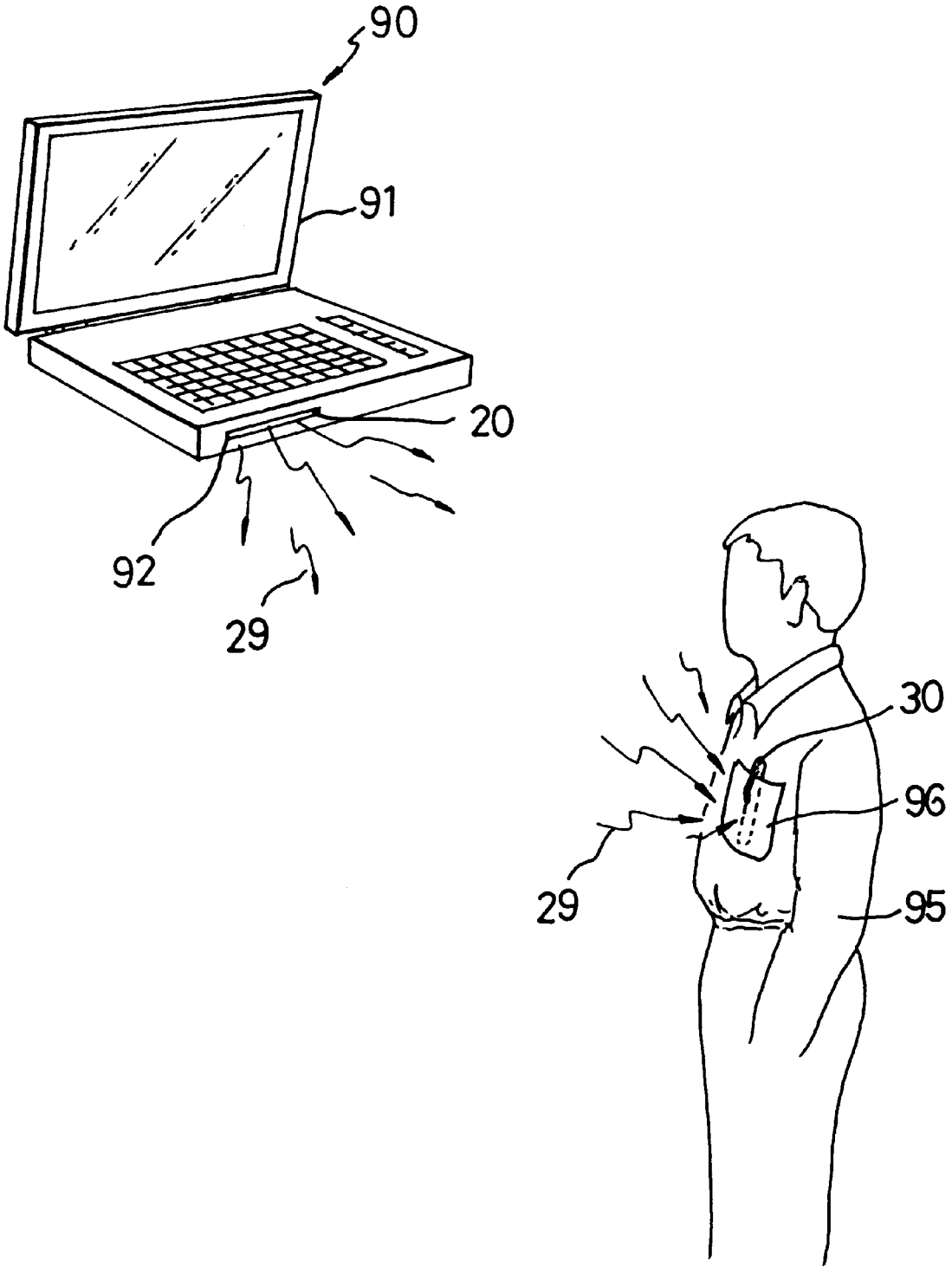
FIG. 1 illustrates an embodiment the present invention.

Referring to FIG. 1, a burglar alarm system 10 is designed for use with an electronic apparatus 90, and comprises a radio transmitter unit 20 and a radio receiver unit 30. The electronic apparatus 90 is, for example, a notebook computer 91 with a slot 92. When in use, the radio transmitter unit 20 is inserted into the slot 92 of the notebook computer 91, and the radio receiver unit 30 is carried by the user 95, for example, in the user's pocket 96. When the notebook computer 91 is moved away from the user 95 beyond a predetermined distance, the radio receiver unit 30 is unable to receive signal from the radio transmitter unit 20. Therefore, the alarm device 35 (see also FIG. 9) of the radio receiver unit 30 is immediately triggered to activate an alarm.

Figure 2:
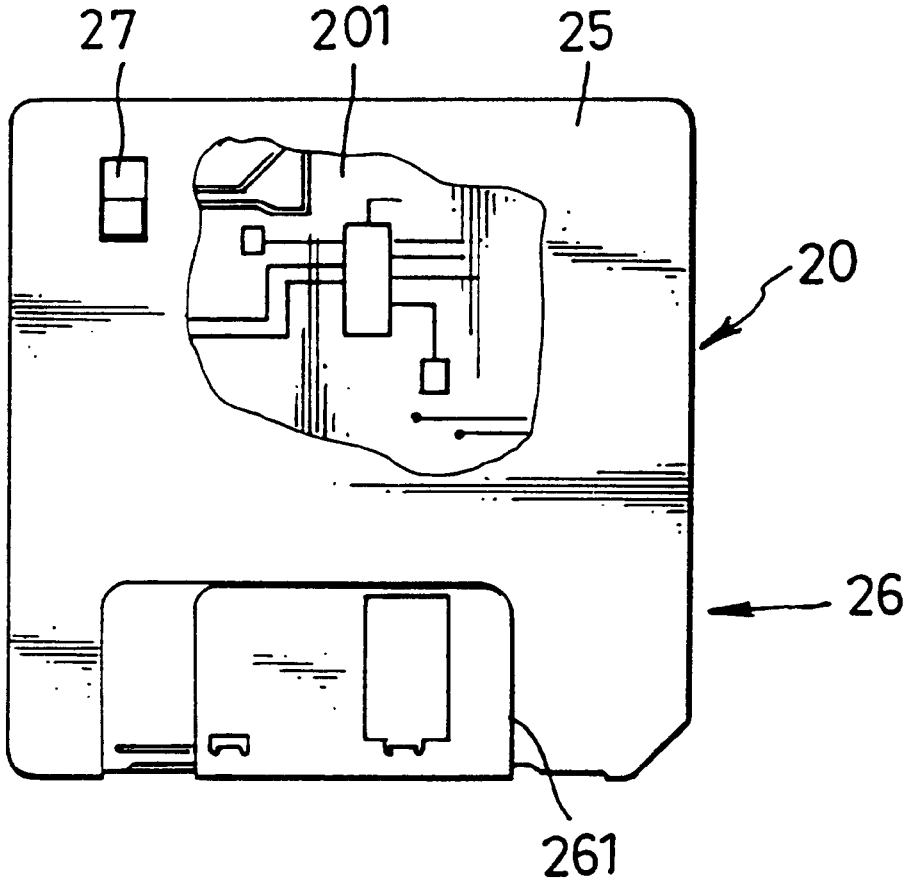
FIG. 2 illustrates a radio transmitter unit according to the present invention.
Figure 3:
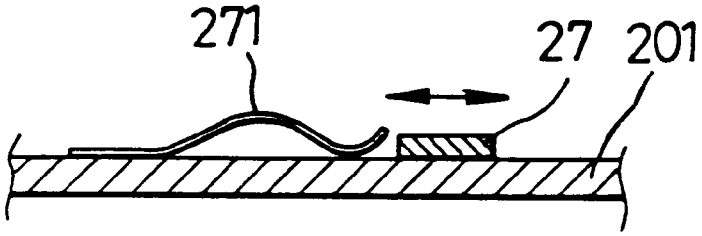
FIG. 3 is a sectional view of the on/off switch of the radio transmitter unit according to the present invention.
Figure 8:
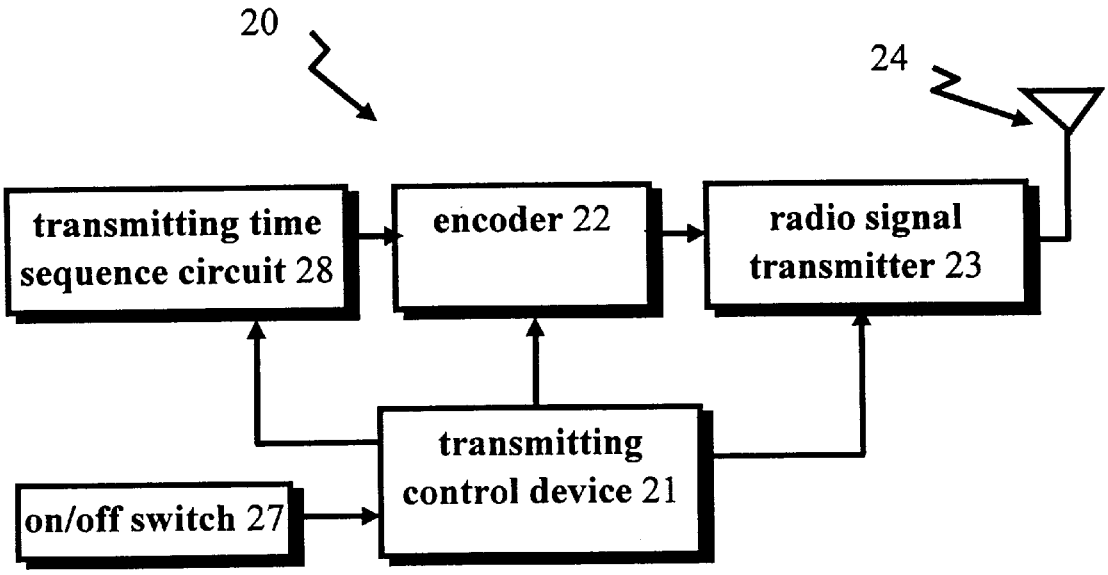
FIG. 8 is a circuit block diagram of the radio transmitter unit according to the present invention.

Referring to FIGS. 2, 3 and 8 and FIG. 1 again, the radio transmitter unit 20 is made as a card-like transmitter unit 26 which comprises a card-like casing 25 in order to fits in the slot 92 of the electronic apparatus 90 (notebook computer 91), a circuit board 201 mounted inside the casing 25, and an on/off switch 27 mounted on the card-like casing 25 to turn on/off the battery power supply (not shown) of the radio transmitter unit 20. The radio transmitter unit 20 has the size of a 3½" diskette (mini-floppy disk). The on/off switch 27 of the radio transmitter unit is made like the anti-writing tab of a 3½" diskette. A metal contact plate 271 is provided at the circuit board 201, and controlled in response to closing or opening of the battery power supply circuit of the circuit board 201 by moving the on/off switch 27 back and forth between two positions. The circuit board 201 of the radio transmitter unit 20 comprises a transmitting circuit formed of an encoder 22, a radio signal transmitter 23, a transmitting antenna 24, and a transmitting control device 21 which controls the operation of the transmitting circuit. When the on/off switch 27 of the radio transmitter unit 20 is switched on, the transmitting control device 21 drives the encoder 22 to output a code signal 29 to the radio signal transmitter 23, enabling the code signal 29 to be transmitted into the air by the radio signal transmitter 23 through the transmitting antenna 24. In order to save power, a transmitting time sequence circuit 28 is provided to control the transmitting frequency of the code signal 29 per every unit time. The transmitting control device 21 can be a microprocessor, or logic circuit means. Because the transmitting control device 21 can be achieved by conventional techniques, it is not described in detail.

Figure 4:
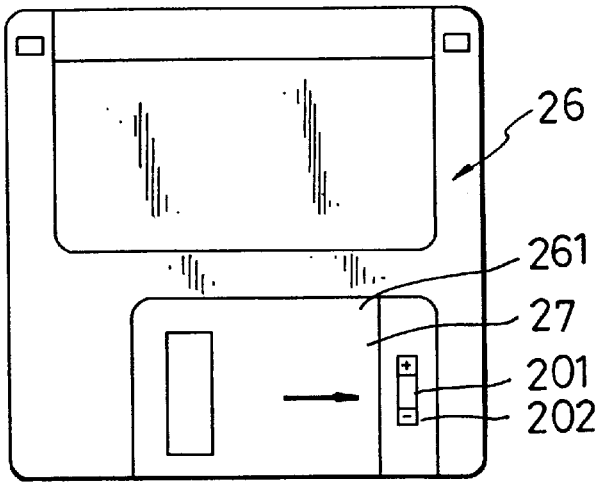
FIG. 4 illustrates an alternate form of the on/off switch of the radio transmitter unit according to the present invention.

FIG. 4 shows an alternate form of the on/off switch 27. When the card-like transmitter unit 26 is inserted into the slot 92 of the notebook computer 91, the shutter 261 is opened to turn on the power. Because of the movement of the shutter 261, the shutter 261 can contact the two metal contacts 202 of the circuit board 201 which are designed to provide a connection to the battery power supply (not show). The material of the shutter 261 shall therefore be conductive material, or the contacting portion of the shutter 261 may include metal contacts 202 of conductive material. When the card-like transmitter unit 26 is removed from the slot 92, the power is therefore turned off.

Figure 5:
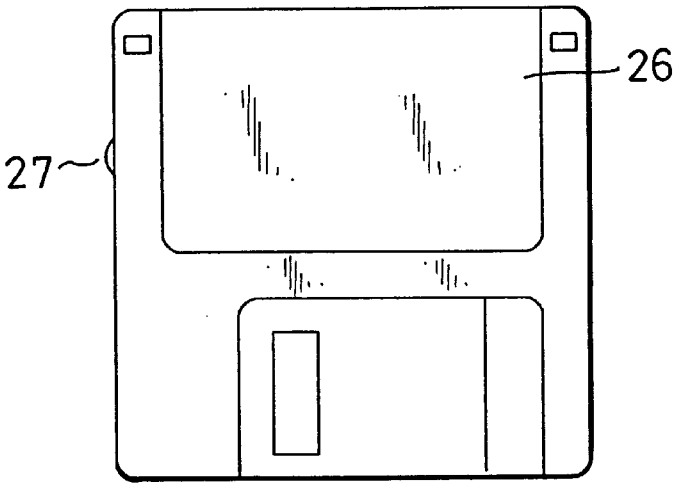
FIG. 5 illustrates another alternate form of the on/off switch on the radio transmitter unit according to the present invention.
Figure 6:
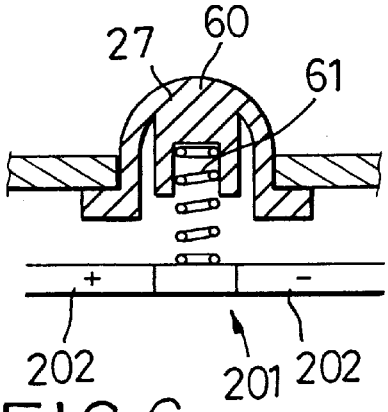
FIG. 6 is an enlarged view of a part of FIG. 5, showing the structure of the on/off switch.

FIGS. 5 and 6 show another alternate form of the on/off switch 27. According to this alternate form, the on/off switch 27 is comprised of a metal push button 60 supported on a spring member 61 above two metal contacts 202, which are respectively connected to the two opposite ends of the battery power supply circuit of the circuit board 201. When the radio transmitter unit 26 is inserted into the slot 92 of the notebook computer 91, the push button 60 is forced downwards into contact with the metal contacts 202, thereby causing the battery power supply circuit of the circuit board 201 to be turned on. Conversely, when the radio transmitter unit 26 is removed out of the slot 92 of the notebook computer 91, the push button 60 is pushed away from the metal contacts 202 by the spring member 61, thereby causing the battery power supply circuit to be turned off.

The advantage of the embodiments of the on/off switch 27 shown in FIG. 4 and FIGS. 5 and 6 is that the radio transmitter unit 20, 26 is automatically turned off when the it is removed from the slot 92 of the notebook computer 91, causing the radio receiver unit 30 to output an alarm signal.

Figure 7:
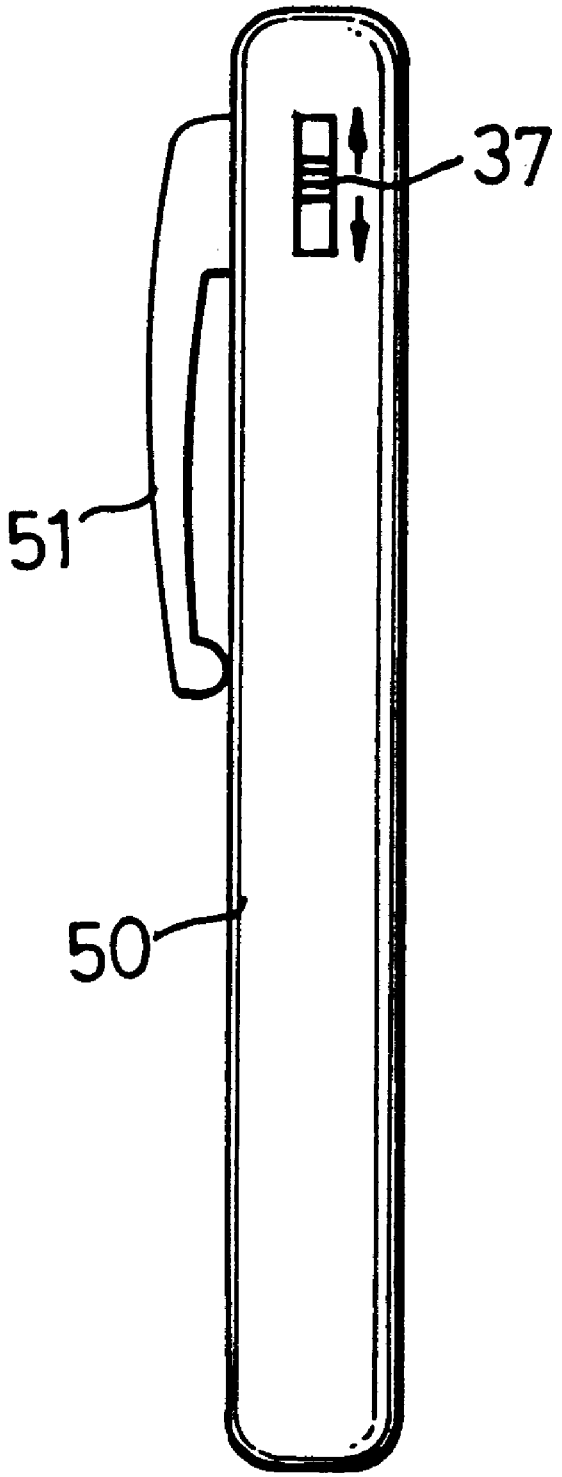
FIG. 7 shows a pen-base radio receiver unit according to the present invention.
Figure 9:
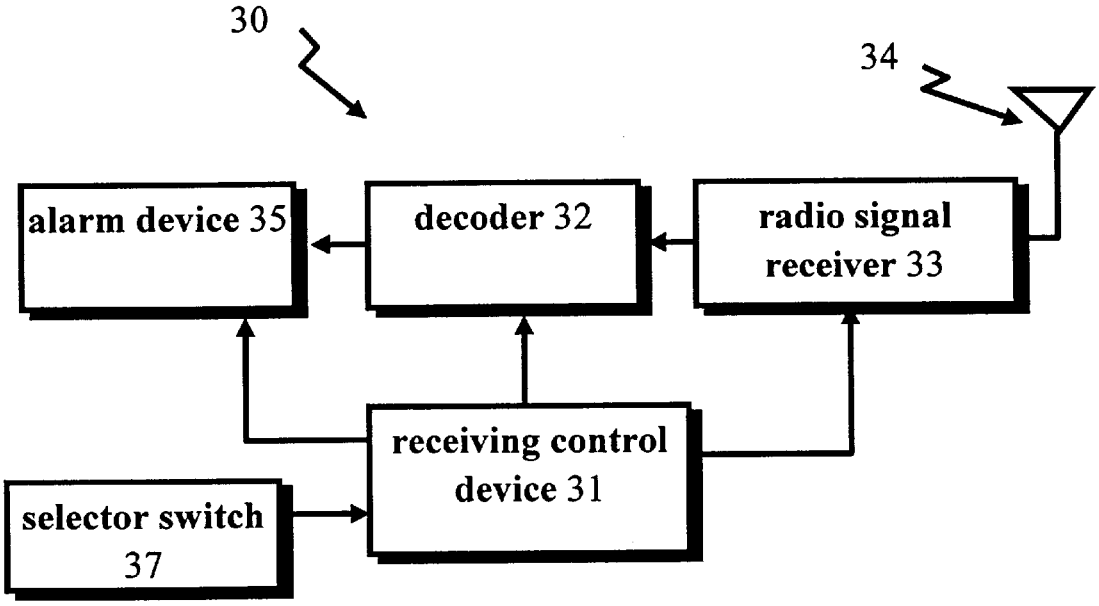
FIG. 9 is a circuit block diagram of the radio receiver unit according to the present invention.

Referring to FIGS. 7 and 9, the radio receiver unit 30 comprises a decoder 32, a radio signal receiver 33, a receiving antenna 34, an alarm device 35, a selector switch 37, and a receiving control device 31 which controls the above electronic components. The selector switch 37 is shifted to turn on/off the power supply circuit (not shown) of the radio receiver unit 30, or to start a search mode. The receiving antenna 34 receives the code signal 29 from the radio transmitter unit 20, and sends the received code signal 29 to the decoder 32 for recognition. If the radio receiver unit 30 receives no signal from the radio transmitter unit 20 when the radio receiver unit 30 is turned on, the receiving control device 31 immediately drives the alarm device 35 to output an alarm signal. The alarm device 35 can be a buzzer, or a vibrator, etc.

If the user 95 forgets the location of the notebook computer 91 or if the notebook computer 91 is stolen by a thief, the user can shift the selector switch 37 to the search mode to search the notebook computer 91. If the radio receiver unit 30 receives the code signal 29 after the selector switch 37 of the radio receiver unit 30 has been shifted to the search mode, the alarm device 35 is driven to output an alarm signal. Therefore, he selector switch 37 can be shifted to set the radio receiver unit 30 into on status, off status, or search mode.

Referring to FIG. 7, the radio receiver unit 30 can be a pen-base radio receiver unit 50 having a clip 51 conveniently for fastening to the user 95's pocket 96.

It is to be understood that the drawings are designed for purposes of illustration only, and are not intended as a definition of the limits and scope of the invention disclosed. For example, the radio transmitter unit can be made in the form of a memory card, or an IC card.

What the invention claimed is:

1. A burglar alarm system for an electronic apparatus with a slot arranged to receive a removable interface device or information storage medium, comprising:

a radio transmitter unit for insertion into the slot of said electronic apparatus, said radio transmitter unit comprising a casing fitting the slot of said electronic apparatus, a transmitting circuit mounted in said casing, and an on/off switch, said transmitting circuit comprised of an encoder, a radio signal transmitter, a transmitting antenna, and a transmitting control device, said encoder being controlled by said transmitting control device to output a code signal to said radio signal transmitted when said on/off switch is switched on, enabling the code signal to be transmitted into the air by radio by said radio signal transmitter through said transmitting antenna, wherein said on/off switch of said radio transmitter unit is arranged to be switched off when said radio transmitter unit is removed from the slot of said electronic apparatus and switched on when said radio transmitter unit is inserted in the slot of the electronic apparatus; and a radio receiver unit, said radio receiver unit comprising a receiving antenna which receives the code signal from said radio transmitter unit, a decoder which recognizes the code signal received by said receiving antenna, an alarm device, a receiving control unit which drives said alarm device to output an alarm signal when said receiving antenna receives no signal from said radio transmitter unit, and switch means to turn on/off said radio receiver unit.

2. The burglar alarm system of claim 1 wherein said radio transmitter unit further comprises a transmitting time sequence circuit which controls the transmitting frequency of said code signal per every unit time.

3. The burglar alarm system of claim 1 wherein said switch means of said radio receiver unit further provides a search mode at which said receiving control device drives said alarm device to output an alarm signal when said radio receiver unit receives the code signal from said radio transmitter unit.

* * * * *